US006102346A

United States Patent [19]

Visser

[11] Patent Number: 6,102,346

[45] Date of Patent: Aug. 15, 2000

[54] EYEGLASS HOLDER

[76] Inventor: Calvin R. Visser, 60460 Mt. Vernon, Rochester, Mich. 48306

[21] Appl. No.: 09/212,463

[22] Filed: Dec. 16, 1998

[51] Int. Cl.[7] ..... F16M 11/00; A47F 5/00

[52] U.S. Cl. ..... 248/200; 248/316.8; 248/902

[58] Field of Search ..... 248/902, 200, 248/316.8

[56] References Cited

U.S. PATENT DOCUMENTS

| | | | |
|---|---|---|---|
| 2,202,242 | 5/1940 | Wortham | 248/902 |
| 3,291,429 | 12/1966 | Neanhouse | 248/902 |
| 3,895,718 | 7/1975 | Seiller | 248/902 |
| 4,011,953 | 3/1977 | Engelman | 248/902 |
| 4,032,223 | 6/1977 | Bradley, Jr. | 351/132 |
| 4,131,401 | 12/1978 | Bradley, Jr. | 425/2 |
| 4,136,934 | 1/1979 | Seron | 351/157 |
| 4,204,750 | 5/1980 | Hilbert | 351/130 |
| 4,432,521 | 2/1984 | Douglas | 248/176 |
| 4,584,633 | 4/1986 | Comfort | 362/253 |
| 5,085,388 | 2/1992 | Cruetz | 248/902 |
| 5,092,666 | 3/1992 | Cress | 351/136 |
| 5,188,322 | 2/1993 | Kinstrey | 248/146 |
| 5,408,728 | 4/1995 | Wisniewski | 248/902 |
| 5,568,872 | 10/1996 | Hinnant, Sr. | 211/13 |
| 5,592,244 | 1/1997 | Vyhmeister | 351/158 |
| 5,921,409 | 7/1999 | Gerber et al. | 248/902 |

*Primary Examiner*—Ramon O. Ramirez
*Assistant Examiner*—Jerome A. DeLuca
*Attorney, Agent, or Firm*—John D. Gugliotta

[57] ABSTRACT

The present invention is an eyeglass holder wherein a storage frame, constructed of plastic, rubber or a combination thereof, that allows for the placement therein of a conventional pair of eyeglasses, for protection and storage, in a safe and convenient location.

4 Claims, 2 Drawing Sheets

EYEGLASS HOLDER

BACKGROUND OF THE INVENTION

1. Field of the Invention

The present invention relates generally to eyeglasses and eye wear, and more specifically to a holder for eyeglasses that allows for convenient storage of a conventional pair of eyeglasses on both horizontal and vertical surfaces.

2. Description of the Related Art

Those of us who are required to wear corrective lenses are often faced with finding a safe place to put our eyeglasses during the periods when they are not being worn. Whether it be while sleeping, during activities that do not require their use, at the hair dresser or at the doctor's office, one places these expensive and delicate items at risk of suffering a variety of damage simply by setting them down. Eyeglasses are often knocked, kicked, stepped on, sat on and otherwise damaged in degrees ranging from scratched lenses and bent frames to complete ruin. Accordingly, there is a need for a means by which one can remove and store his or her eyeglasses in a safe manner while maintaining easy access to them. The development of the present invention fulfills this need by providing a device into which a conventional pair of eyeglasses can be placed and stored in a secure fashion.

A search of the prior art did not disclose any patents that read directly on the claims of the instant invention. However, several references to devices used to secure eyeglasses for a variety of purposes were discovered. These devices neither anticipate nor disclose any embodiment that would preclude the novelty and the utilitarian functionality of the features of the present invention.

U.S. Pat. No. 5,592,244, issued in the name of Vyhmeister, discloses a holding device for eyeglasses wherein a clamping device is fit with a suction cup. The clamp is used to secure a conventional pair of eyeglasses, allowing them to be suspended or otherwise secured to a surface.

U.S. Pat. No. 5,568,872, issued in the name of Hinnant, describes an eyeglass holder that allows a user to hang a conventional pair of eyeglasses therefrom, suspending them from the hinge portion between the eyeglass frame and stem. The holder is designed to be either free-standing or hung from an automobile rear view mirror.

U.S. Pat. No. 5,188,322, issued in the name of Kinstrey, describes an eyeglass holder wherein a padded cloth article is designed to be inserted in a conventional drinking mug or the like. Secured to the rim of the mug, the device allows for the placement of conventional eyeglasses therein for convenient storage and protecting them from damage.

U.S. Pat. No. 4,432,521, issued in the name of Douglas, describes an eyeglass cradle for storing conventional eyeglasses wherein a padded cloth article is suspended across the interior portion of a base frame consisting of a length of U-shaped channel material.

U.S. Pat. No. 4,584,633, issued in the name of Comfort, discloses an combination nightlight and eyeglass holder.

Other patents of general relation and not of any particular relevance, but warranting mention include the following:

U.S. Pat. No. 5,092,666, issued in the name of Cress;

U.S. Pat. No. 4,204,750, issued in the name of Hilbert;

U.S. Pat. No. 4,136,934, issued in the name of Seron;

U.S. Pat. No. 4,131,401, issued in the name of Bradley; and

U.S. Pat. No. 4,032,223, issued in the name of Bradley.

While several features exhibited within these references may be incorporated into this invention, alone and in combination with other elements, the present invention is sufficiently different so as to make it distinguishable over the prior art.

SUMMARY OF THE INVENTION

The present invention consists of an eyeglass holder wherein a storage frame, constructed of plastic, rubber, or other like formable materials, or a combination thereof, that allows for the placement therein of a conventional pair of eyeglasses for protection and storage. The semi-rigid, resilient frame secures the eyeglasses with a gravity induced friction fit, providing a protective shield for the lenses and absorbing the shock associated with falling, being crushed, sat upon or stepped on. Generally C-shaped in design that match the overall shape of conventional eyeglasses, the frame attaches to the eyeglasses on each stem and provides support at the nose piece located on the bridge. Fit with an optional suction cup type securing device, the eyeglass holder can be secured to smooth, horizontal and non-horizontal surfaces, such as automobile windshields, allowing for convenient access thereto.

It is therefore an object of the present invention to provide an eyeglass holder that will secure and support a conventional pair of eyeglasses, protecting them from damage caused by falls or contact with other objects.

It is another object of the present invention to provide an eyeglass holder that will secure and support a conventional pair of eyeglasses, storing them for convenient retrieval.

It is another object of the present invention to provide an eyeglass holder that will accept a variety of conventional eyeglass designs.

It is another object of the present invention to provide an eyeglass holder that provides friction fit securement of the eyeglass stems as well as a support for the eyeglass bridge nose piece.

It is another object of the present invention to provide an eyeglass holder that is constructed of lightweight, strong and durable materials such as plastic, rubber or other like formable materials, or a combination thereof.

It is another object of the present invention to provide an eyeglass holder that is of a simple design that is easy to produce, resulting in a cost-effective manufacture.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

LIST OF REFERENCE NUMBERS

10 Eyeglass Holder
11 Frame
12 Bridge Support
13 Stem Support
15 Stem Securing Clasp
16 Securing Tabs
17 Stem Receiving Cavity
20 Bridge Rest
25 Nose Rest Pads
26 Eyeglasses
27 Bridge Rest Mid-Section
28 Eyeglass Stems
30 Suction Cup
31 Mounting post
32 Suction Cup Securing Aperture
35 Eyeglass Lenses

DESCRIPTION OF THE PREFERRED EMBODIMENTS

1. Detailed Description of the Figures

Figure 1:
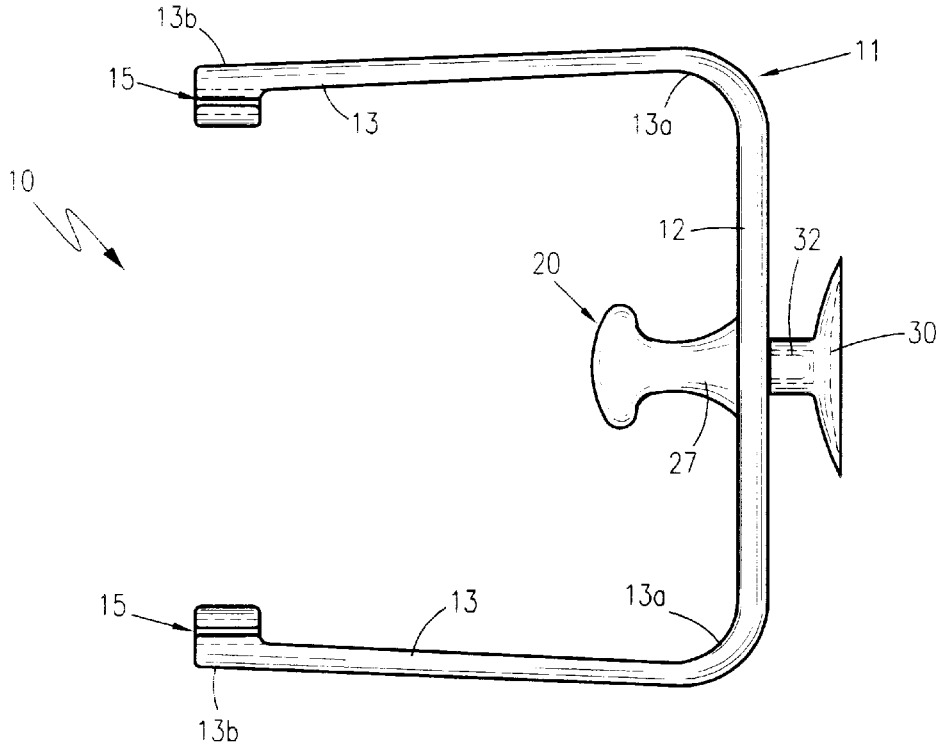
FIG. 1 is a top view of the eyeglass holder, according to the preferred embodiment of the present invention.
Figure 2:
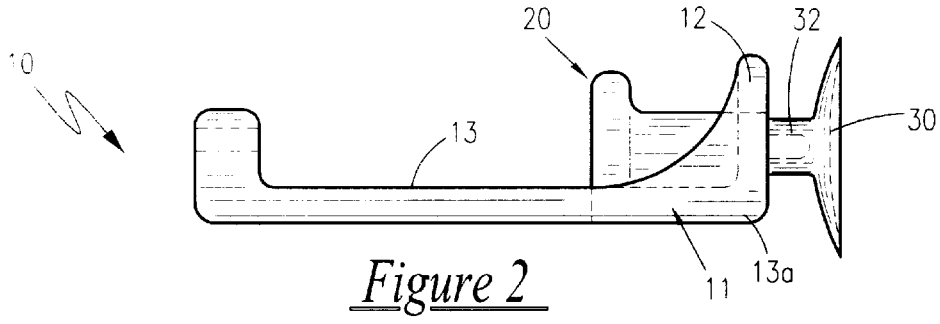
FIG. 2 is a side view of the eyeglass holder, according to the preferred embodiment of the present invention.
Figure 3:
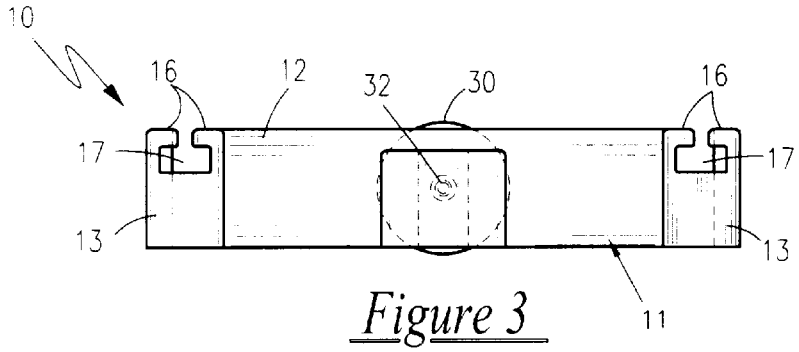
FIG. 3 is a rear view of the eyeglass holder, according to the preferred embodiment of the present invention.

Referring now to FIGS. 1–3, depicted is the eyeglass holder 10 according to the preferred embodiment of the present invention. The eyeglass holder 10 consists of a generally C-shaped frame 11 consisting of an elongated bridge support 12 terminated at each end by the proximal end 13*a* of a linearly elongated stem support 13. The stem supports 13 extend perpendicularly from the bridge support 12, parallel to one another. The general shape and contour of the frame 11 corresponds to that of a conventional pair of eyeglasses (not shown in FIGS. 1–3). An eyeglass stem securing clasp, hereinafter stem securing clasp 15, is located at the distal end 13*b* of each stem support 13. The stem securing clasps 15 consist of a pair of curved securing tabs 16 that are biased against one another by the resilient nature of the material used to construct the frame 11 such that the tips of the securing tabs 16 maintain a position in close proximity to one another and forming a stem receiving cavity 17 into which the stem of a conventional pair of eyeglasses (not shown in FIGS. 1–3) can be inserted and secured. A bridge rest 20 centered along the bridge support 12 on the inside portion of the C-shaped frame 11 allows for the nose rest of a conventional pair of eyeglasses to rest thereupon.

The bridge rest 20 is contoured with a generally hourglass-like shape such that the nose rest pads 25 of a conventional pair of eyeglasses 26, when placed within the eyeglass holder 10, is cradled in the bridge rest mid-section 27 of the bridge rest 20, preventing the eyeglasses from sliding in either a traversing or longitudinal direction. Placed in the eyeglass holder 10 with the nose rest pads 25 resting on the bridge rest 20, the eyeglass stems 28 extend back in a direction generally parallel to the stem supports 13 and intersecting the stem securing clasps 15.

The curved nature of the securing tabs 16 create a stem receiving cavity 17 into which the stem of a conventional pair of eyeglasses (not shown in FIGS. 1–3) can be inserted and secured. The securing tabs 16 are forced to distort by forcing the stem there between and the stem is allowed to enter the stem receiving cavity 17. The resilient nature of the securing tabs 16 forces them back together once the stem has entered the stem receiving cavity 17.

Optionally, a suction cup 30 allows for the eyeglass holder 10 to be secured to a smooth surface such as an automobile windshield, in a position of convenient access. The suction cup 30 is secured to the frame 11 by a mounting post 31 that is inserted into a suction cup securing aperture 32 molded in the design of the suction cup 30, although other securing means such as a hinge mechanism may be equally suitable.

2. Operation of the Preferred Embodiment

Figure 4:
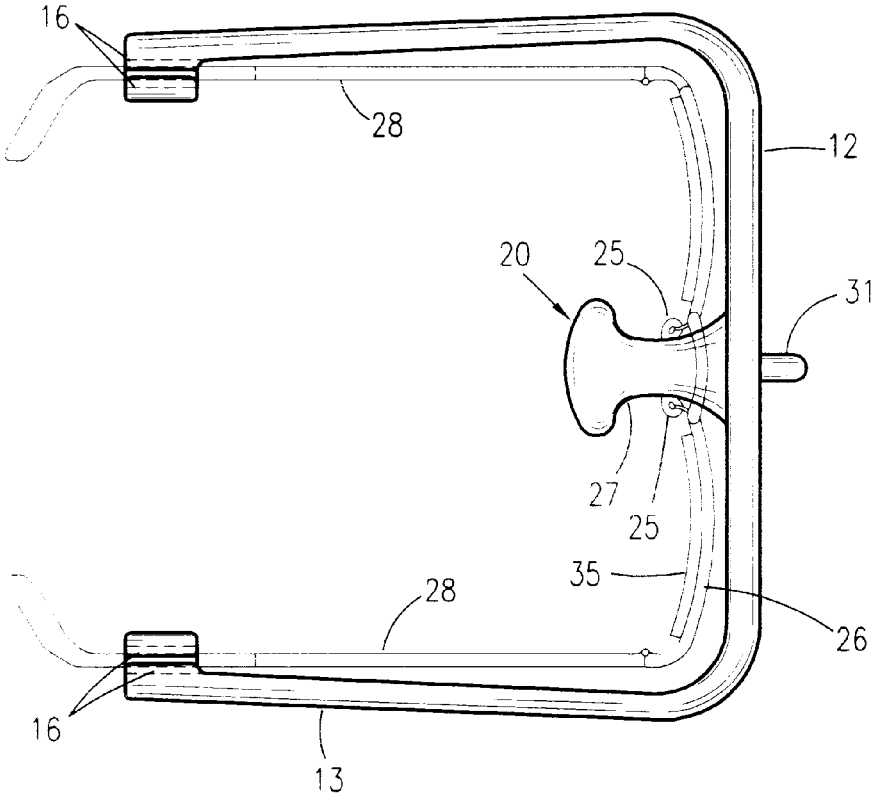
FIG. 4 is a top view of the eyeglass holder depicting its use in securing a pair of convention eyeglasses, according to the preferred embodiment of the present invention.
Figure 5:
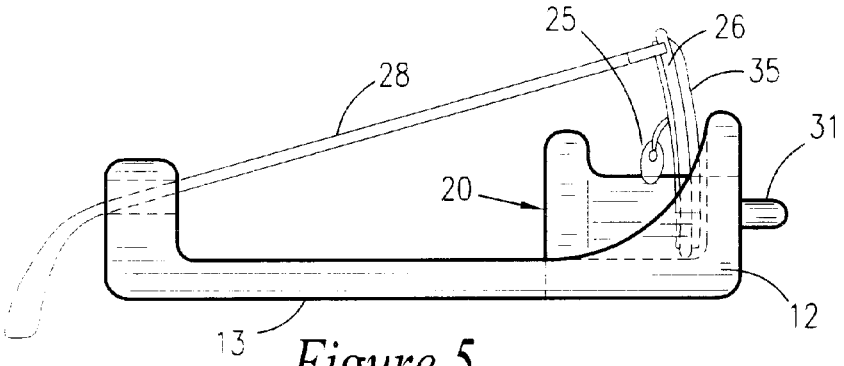
FIG. 5 is a side view of the eyeglass holder depicting its use in securing a pair of conventional eyeglasses, according to the preferred embodiment of the present invention.

In accordance with the preferred embodiment of the present invention and as shown in FIGS. 4–5, the eyeglass holder 10 is used in the manner described herein below.

Depending upon the type of surface or structure that the eyeglass holder 10 is being used upon, the suction cup 30 may be attached to the frame 11 via the mounting post 31. The eyeglasses 26 are placed into the eyeglass holder 10 with the nose rest pads 25 supported by the bridge rest mid-section 27 of the bridge rest 20. The eyeglass stems 28 are inserted into the stem securing clasps 15 where they are retained by the securing tabs 16. Secured to the eyeglass holder 10 and positioned within the concave portion of the C-shaped frame 11, the eyeglasses 26 can be placed in a position of convenient location and retrieved both quickly and easily. The bridge support 12 and the stem supports 13 serve to protect the eyeglasses 26 from damage should they fall or otherwise become subject to a potentially damaging force. The bridge support 12 also serves to shield the eyeglass lenses 35 from scratches and abrasions.

While the preferred embodiments of the invention have been shown, illustrated, and described, it will be apparent to those skilled in this field that various modifications may be made in these embodiments without departing from the spirit of the present invention. It is for this reason that the scope of the invention is set forth in and is to be limited only by the following claims.

What is claimed is:

1. An eyeglass holder for storing and protecting a conventional pair of eyeglasses in a safe and convenient manner, said eyeglass holder comprising:

a generally C-shaped frame having an elongated bridge support with a first end oposite a second end, said first end having the proximal end of a linearly elongated first stem support connected thereto and extending therefrom in a generally perpendicular direction, said second end having the proximal end of a linearly elongated second stem support connected thereto and extending therefrom in a generally perpendicular direction, said first and second stem supports oriented parallel to one another;

bridge securing means located at the midpoint of said bridge support between said first end and said second end, said bridge securing means for supporting a conventional pair of eyeglasses from a nose rest portion thereof wherein said bridge securing means further comprises an hourglass-shaped protrusion having a narrow mid-section that cradles and supports a nose rest portion of a conventional pair of eyeglasses preventing said eyeglasses from sliding therein in either a traversing or longitudinal direction in relation to said frame; and stem supporting means located at the distal end of said first stem support and at the distal end of said second stem support said stem supporting means accepting and releasably securing stems of a conventional pair of eyeglasses; and wherein said eyeglass holder supports said eyeglasses for protective and storage purposes, said frame protecting said eyeglasses from falls and other like damaging forces while maintaining said eyeglasses in a position of convenient access.

2. The eyeglass holder of claim 1 wherein said stem securing means further comprises a pair of curved securing tabs that are biased against one another by the resilient nature of the material used to construct said frame such that the tips of said securing tabs maintain a position in close proximity to one another and forming a stem receiving cavity into which stems of a conventional pair of eyeglasses are inserted and releasably secured.

3. The eyeglass holder of claim 2 wherein said securing tabs are forced slightly apart by inserting stems of a conventional pair of eyeglasses between said securing tabs and entering said stem receiving cavity, the resilient nature of said securing tabs forcing said securing tabs back together once the stems of a conventional pair of eyeglasses has entered said stem receiving cavity, securing the stems in said stem receiving cavity.

4. The eyeglass holder of claim 1 further comprising a suction cup means attached to said frame for supporting said eyeglass holder from a smooth surface.

* * * * *